US006147590A

United States Patent [19]

Mikolcic

[11] Patent Number: 6,147,590

[45] Date of Patent: Nov. 14, 2000

[54] ELECTRONIC TREADLE LINKAGE ASSEMBLY

[76] Inventor: Allen Mikolcic, 64 Huntington Woods, Bay Village, Ohio 44140

[21] Appl. No.: 09/393,539

[22] Filed: Sep. 10, 1999

[51] Int. Cl.[7] ..... H01C 10/00

[52] U.S. Cl. ..... 338/153; 338/108; 74/513; 74/512

[58] Field of Search ..... 338/47, 108, 153, 338/215; 74/96, 512, 513, 514, 515 R, 515 E, 516, 518, 560, 561

[56] References Cited

U.S. PATENT DOCUMENTS

| | | | |
|---|---|---|---|
| 792,241 | 6/1905 | Sturtevant | 74/512 |
| 1,438,288 | 12/1922 | Barbarou | 74/560 |
| 1,990,447 | 2/1935 | Apple et al. | 338/96 |
| 2,379,774 | 7/1945 | Wyer | 338/153 |
| 4,528,590 | 7/1985 | Bisacquino et al. . | |
| 4,958,607 | 9/1990 | Lundberg | 74/513 |
| 5,063,811 | 11/1991 | Smith et al. | 74/513 |
| 5,241,936 | 9/1993 | Byler et al. | 74/51 |
| 5,408,899 | 4/1995 | Stewart | 74/514 |
| 5,507,201 | 4/1996 | Fairbairn et al. | 74/514 |
| 5,693,927 | 12/1997 | Wilson | 338/153 |
| 5,768,946 | 6/1998 | Fromer et al. | 74/514 |

*Primary Examiner*—Karl D. Easthom

[57] ABSTRACT

A treadle assembly provides an electrical signal to an electronic controlled engine. The assembly includes a treadle suspended in the operator compartment. The treadle is pivotally mounted to a lever which pivots in response to the operator imposed depression of the treadle which, in turn, actuates a rotatable gear. The gear is in operative engagement with the potentiometer and an electrical signal is sent to the engine in response to rotation of the gear. The lever and gear are preferably interconnected by a slot and pin connection to reduce manufacturing costs associated with the components and accommodate misalignment during assembly and tolerance stackup associated with assembling individual components together.

11 Claims, 2 Drawing Sheets

ELECTRONIC TREADLE LINKAGE ASSEMBLY

BACKGROUND OF THE INVENTION

1. Field of the Invention

This invention pertains to the art of electronic control engines, and more particularly to providing an electrical input to the engine. The invention relates to an electronic treadle or pedal assembly that is simple to manufacture and assemble and is less expensive than known alternatives.

2. Background Art

Manufacturers continue to develop electronically controlled engines that are responsive to electrical signals associated with various operating parameters of the vehicle. One such parameter is the driver's desire for power that is input through depression of an accelerator pedal or treadle assembly located in the vehicle operator compartment. Depressing the treadle provides a suitable electronic signal to be sent to the electronic control unit (ECU) associated with the engine. For example, a potentiometer generates an electronic signal corresponding to the degree of depression of the treadle. One such commercially successful unit is shown and described in U.S. Pat. No. 4,528,590, the disclosure of which is commonly owned by the assignee of the present invention, and the details of which are incorporated herein by reference.

It has been proposed that mating components be used to transfer the force imposed by depression of a treadle to the input of a position sensor or rotary potentiometer. However, increasing the precision between the mating components increases the manufacturing costs and also increases the potential for wear. Accordingly, a need exists for a simplified design that achieves the same objectives, but at a decreased cost and that accommodates tolerance stackup conditions.

SUMMARY OF THE INVENTION

The present invention contemplates a new and improved treadle assembly for an electronic braking system that overcomes the above-referenced problems and others and provides a simple, economical assembly.

The treadle assembly includes a housing having a lever pivotally mounted thereto with a first end that engages a treadle and a second end engaging a rotatable member. The rotatable member is secured to the lever via a slot and pin assembly to simplify the manufacturing costs and alleviate misalignment concerns. A position sensor provides an output signal indicative of the movement of the rotatable member and, likewise, the degree of depression of the treadle.

The slot is elongated and extends generally radially on the rotatable member for receiving the pin extending from the lever.

A primary advantage of the invention is the ability to decrease the manufacturing costs associated with this design.

Yet another advantage of the invention resides in the minimal number of components of the assembly without any attendant loss in function.

Still another advantage of the invention is associated with the decreased sensitivity to misalignment.

Still other advantages and benefits of the invention will become apparent to those skilled in the art upon a reading and understanding of the following detailed description.

BRIEF DESCRIPTION OF THE DRAWINGS

The invention may take physical form in various parts and arrangements of parts, a preferred embodiment of which is described in detail in this specification. A preferred arrangement of the invention is illustrated in the accompanying drawings, which include.

DETAILED DESCRIPTION OF THE PREFERRED EMBODIMENT

Figure 1:
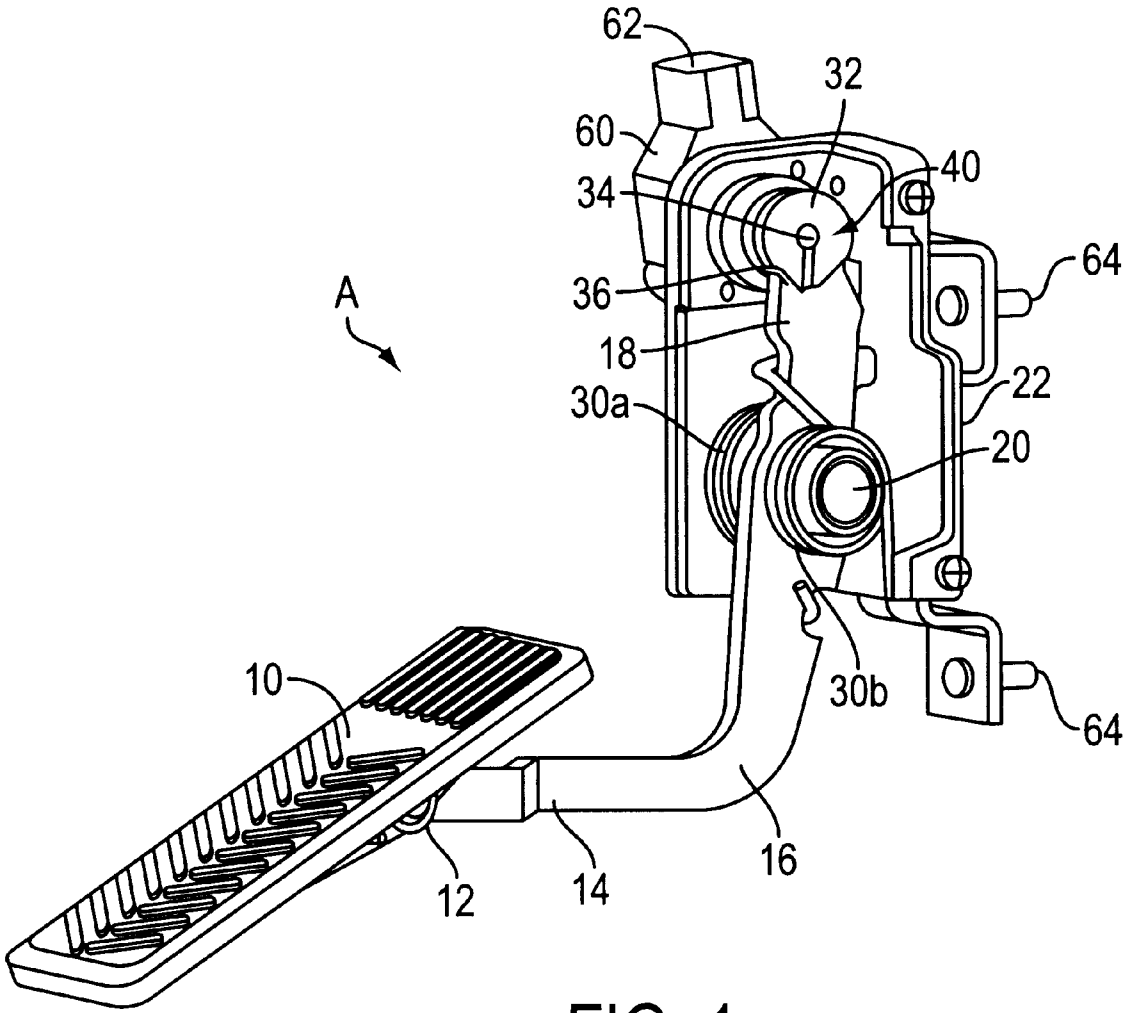
FIG. 1 is a perspective view of the treadle assembly with a portion of the housing removed for illustrating the internal structural arrangement.

Referring now to the drawings wherein the showings are for the purposes of illustrating the preferred embodiment of the invention only and not for limiting the invention, the FIGURES show a treadle assembly A such as used in a heavy duty vehicle or truck having an electronically controlled engine. More specifically, the treadle assembly A includes a pedal or treadle 10 having a non-slip material such as plastic, rubber, or the like thereon. The treadle is pivotally mounted via pin 12 to a first end 14 of pedal lever or arm 16. In the illustrated embodiment, the lever has a generally L-shape. A second end 18 of the lever is disposed on an opposite side of a pivot pin 20 from the first end and the pivot pin secures the lever to housing 22. A biasing member, such as a pair of springs 30*a*, 30*b* located on opposite sides of the lever and about the pivot pin 20, urges the lever to the position shown in FIG. 1.

Figure 2:
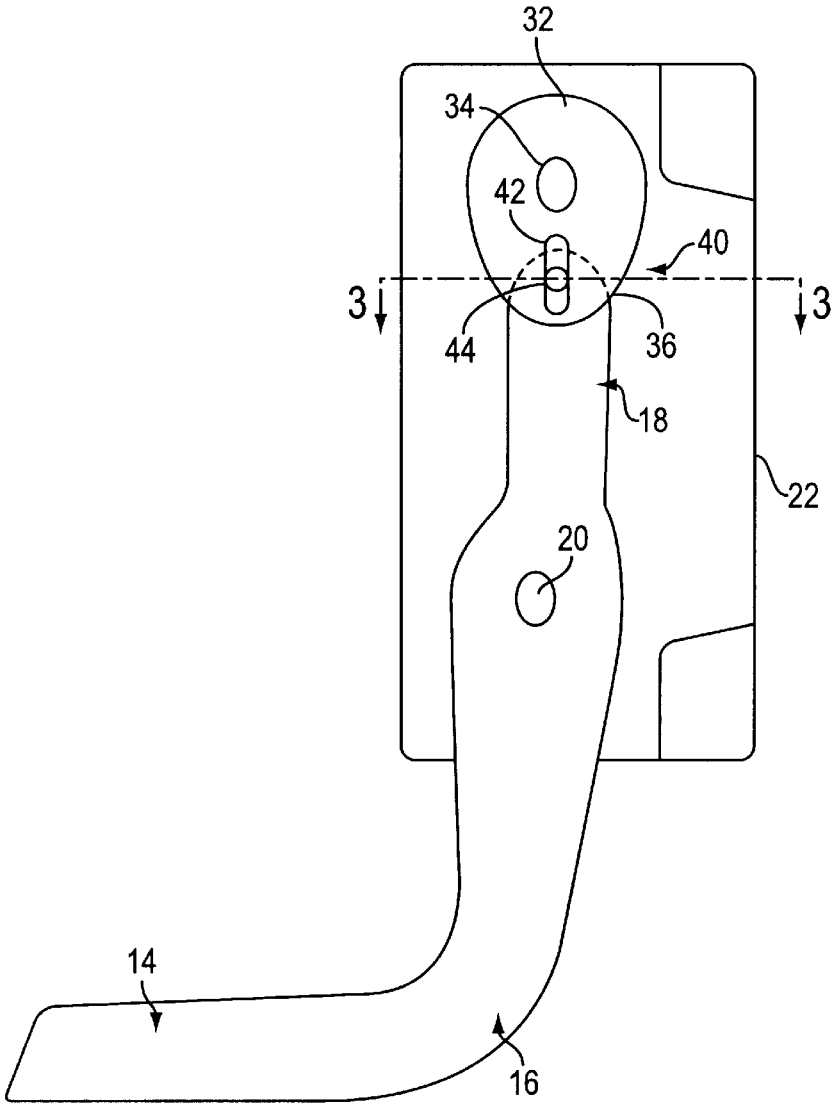
FIG. 2 is a diagrammatic elevational view of the assembly.

The second end 18 of the lever cooperates with a rotatable member or gear 32. The gear rotates about an axle 34 which passes through a sidewall of the housing 22. The gear includes a lobe 36 which accommodates a slot and pin assembly 40 that connects the gear to the lever second end. More particularly, in the preferred arrangement an elongated slot 42 is provided in the rotatable gear and the pin 44 extends from the lever second end (FIG. 2). Of course it will be recognized by those skilled in the art that the locations of the slot and pin can be reversed without departing from the scope and intent of the subject invention.

Figure 3:
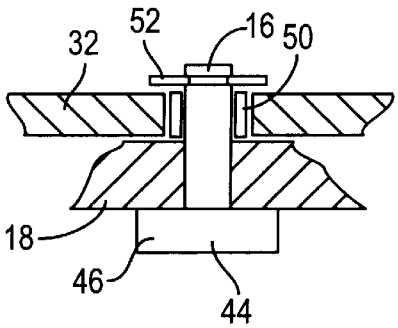
FIG. 3 is a cross-sectional view, taken generally along the lines 3—3 of FIG. 2.

As illustrated in FIG. 3, the pin 44 includes an enlarged shoulder 46 and a shaft portion 48 that extends through the slot 42. A roller bearing or similar bearing member 50 is interposed between the pin and the gear to minimize friction associated between the relatively moving components. In addition, a snap ring 52 is received adjacent one end of the pin to secure the slot and pin assembly together.

The slot and pin connection effectively transfers the pivoting motion of the lever second end into rotational movement of the gear about its axle 34. The rotation of the axle 34, in turn, is input to a position sensor such as potentiometer 60 having a connection area 62 from which a lead extends for communicating an electrical output signal to the vehicle engine.

The housing 22 is preferably secured to the operator compartment through a conventional bracket assembly 74, although it will be understood that still other mounting arrangements can be used without departing from the scope and intent of the present invention.

Pivotal movement of the treadle lever caused by depressing the treadle 10 urges the lever second end 18 to pivot about pin 20. The slot and pin connection transfers this motion into selective rotational movement of the gear 32. As will be appreciated, the slot and pin connection accommodates tolerance stackup concerns that are associated with other more precisely fit components. In this instance, the slot and pin connection allows the components to be manufactured from stamp metal rather than employing a more expensive laser cut where a higher degree of precision of the components is required. No loss in function, however, results from the less expensive manufacturing process and structural arrangement. The assembly is also more forgiving of misalignment that may occur between the components so that tolerance stackup that is associated with more precisely fit components is less of a problem with the present invention.

In operation, as the driver depresses the treadle, the treadle arm pivots and causes the gear to rotate. The gear rotates and provides an input to the potentiometer which sends a signal to the electronic controlled engine (not shown). The lever, gear, and potentiometer are all secured to the housing so that they properly interact with one another. The spring assembly urges the lever to the deactuated position, so that the treadle is disposed in a first or idle position as illustrated.

The invention has been described with reference to the preferred embodiment. Obviously, modifications and alterations will occur to others upon a reading and understanding of this specification. For example, the slot and pin connection can be reversed. Alternate materials of construction could also be used, or the design shape or configuration of the individual components may be altered. Likewise, a different type of biasing spring could also be used. It is intended that these modifications and alterations are included in the present specification in so far as they come within the scope of the appended claims or the equivalents thereof.

What is claimed is:

1. A treadle assembly for an electronic motor vehicle system comprising:

a treadle adapted for selective depression by an operator's foot;

a lever operatively engaging the treadle adjacent a first end and having a second, output end, said lever including a pin at the second end of the lever;

a rotatable member located in operative relation to the output end of the lever having a closed-ended slot adapted to receive said pin such that translational movement of the lever causes the pin to slide in the slot and thereby transfer translational movement of the lever into selective rotation of the rotatable member; and a position sensor operatively associated with the rotatable member for providing an output signal indicative of the degree of depression of the treadle.

2. The invention of claim 1 further comprising a housing and pivot member mounted thereto, the pivot member receiving an intermediate portion of the lever for mounting the lever for pivoting movement relative thereto.

3. The invention of claim 2 further comprising an axle secured to the housing and about which the rotatable member rotates, the position sensor mounted to the housing and receiving the axle therein.

4. The invention of claim 1 further comprising a biasing member urging the lever toward a deactuated position.

5. The invention of claim 1 further wherein the slot is provided on the rotatable member and extends radially from said rotatable member's axis of rotation.

6. The invention of claim 5 wherein the rotatable member includes a lobe having said slot formed therein.

7. The invention of claim 1 wherein the treadle is pivotally mounted to the first end of the lever.

8. A treadle assembly for supplying an electrical signal to an electronic control unit of a vehicle, the assembly comprising:

a housing;

a lever pivotally mounted to the housing and having a first end extending from the housing and a second end spaced from the first end, said lever including a pin at the second end of the lever;

a treadle secured to the lever first end and adapted for selective depression by a vehicle operator;

a gear assembly comprising a gear and an axle for securing the gear assembly to the housing, said gear including a closed-ended slot in said gear adapted to receive said pin such that translational movement of the lever causes the pin to slide in the slot and thereby transfer said translational movement of the lever into selective rotation of the gear assembly; and a potentiometer receiving an end of the axle extending from the gear assembly to supply an electrical signal to the electronic control unit in response to depression of the treadle by the operator.

9. The invention of claim 8 further comprising a biasing spring interposed between the housing and the lever for urging the treadle toward the deactuated position.

10. The invention of claim 8 wherein the gear assembly includes the slot therein extending in a radial direction from the axle and pin on the second end of the lever.

11. The invention of claim 8 wherein the slot is elongated and extends radially from the axle in a lobe portion the gear.

* * * * *